US009988252B1

(12) United States Patent
Kunstadt

(10) Patent No.: US 9,988,252 B1
(45) Date of Patent: Jun. 5, 2018

(54) SNATCH BLOCK WITH SOFT HINGE

(71) Applicant: Robert Kunstadt, West Hurley, NY (US)

(72) Inventor: Robert Kunstadt, West Hurley, NY (US)

( * ) Notice: Subject to any disclaimer, the term of this patent is extended or adjusted under 35 U.S.C. 154(b) by 0 days. days.

(21) Appl. No.: 15/826,950

(22) Filed: Nov. 30, 2017

(51) Int. Cl.
*B66D 3/04* (2006.01)
*B63H 9/10* (2006.01)

(52) U.S. Cl.
CPC ..... *B66D 3/046* (2013.01); *B63H 9/10* (2013.01)

(58) Field of Classification Search
CPC ..... B66D 3/04; B66D 3/046
See application file for complete search history.

(56) References Cited

U.S. PATENT DOCUMENTS 230,994 A 8/1880 Bitting
268,364 A 11/1882 Ferall
360,050 A 3/1887 Redmond
1,327,876 A * 1/1920 Nyblad ..... B66D 3/04 116/173
1,349,618 A 8/1920 La Ganke
1,393,723 A 10/1921 Schermuly
1,907,436 A * 5/1933 Niemi ..... B66D 3/04 294/111
2,661,231 A * 12/1953 Caldwell ..... B66C 1/12 254/414
4,074,892 A * 2/1978 Harken ..... B66D 3/08 114/109
4,079,916 A * 3/1978 Einhorn ..... B22D 19/12 2/909
6,305,669 B1 * 10/2001 Harken ..... B63H 9/10 254/412
6,540,207 B1 * 4/2003 Barnes ..... H02G 1/04 254/134.3 PA
7,988,132 B2 8/2011 Lange
8,002,244 B2 * 8/2011 Curchod ..... B66D 3/04 254/390
8,631,607 B2 * 1/2014 Broadhead ..... B60J 5/0416 49/352
2004/0195554 A1 * 10/2004 Renton ..... B63B 21/04 254/390
2007/0094851 A1 * 5/2007 Yang ..... B66D 1/7415 24/115 R
2009/0200530 A1 * 8/2009 Curchod ..... B63H 9/08 254/390
2012/0228571 A1 * 9/2012 Curchod ..... F16H 55/36 254/416
2016/0152452 A1 * 6/2016 Barnet ..... B63B 21/04 254/390
2016/0152453 A1 * 6/2016 Wescott ..... B66D 3/04 182/3

* cited by examiner

*Primary Examiner* — Michael E Gallion

(57) ABSTRACT

A line-handling block permits a soft attachment to perform the functions of securing the block to the boat, hinging the block's cheeks at one end, and locking the cheeks together positively but releaseably at its other end. The soft attachment so arranged, reinforces the block against destructive strain and aligns the block for a fair lead. Increased force on the soft attachment has the desirable effect of engaging it positively about the block to restrain unwanted opening. The block may be 3D-printed in "sparse mode" with a hard-plastic shell having a lightweight honeycomb interior, hence being so light that it floats if dropped overboard.

7 Claims, 3 Drawing Sheets

SNATCH BLOCK WITH SOFT HINGE

FIELD OF THE INVENTION

This invention relates to the field of pulleys for use in connection with ropes, in particular pulleys for marine use known as "blocks" for handling ropes such as sheets and lines on boats such as sailboats.

BACKGROUND ART

In connection with marine hardware, and as used in this Specification, "soft" means a connection established by a flexible material such as rope, as distinguished from a rigid material such as stamped, forged or machined stainless. Blocks are known in which a soft loop is employed to secure the block to a boat's attachment point. Snatch blocks are known in which a rope to be controlled can be fed onto and off of a block's sheave without need for disconnecting either end of the controlled rope.

SUMMARY AND OBJECTS OF THE INVENTION

In accordance with the invention, novel structure is disclosed to permit a soft attachment to perform the functions of securing the block to the boat, hinging the block's cheeks at its one end, and locking the cheeks together positively but releaseably at its opposite end. At the same time, such soft attachment effectively reinforces the block against destructive strain and aligns the block for a fair lead. The structure is configured such that increase of tensional force upon the soft attachment has the desirable effect of engaging it ever more positively about the block to restrain unwanted opening thereof.

Since the soft attachment takes up force, the block of the invention need not be metal or even solid plastic material—rather it may advantageously be 3D-printed by the FDM process in "sparse mode" out of ABS/PC or the like. Hence it may have a hard-plastic shell with a lightweight honeycomb interior. The block as 3D-printed, may be so light in weight that it floats in case it is dropped overboard by mistake. Since snatch blocks may need to be repeatedly repositioned about a boat—which requires them to be temporarily detached from the boat—risk of dropping them overboard is a concern for sailors.

According to the invention there is no need to provide a rigid mechanism to latch the cheeks together by means of machining, forging, stamping or the like, since the soft attachment to the boat also serves as a hinge and latch for releasably closing and opening the cheeks as may be desired by a user.

DESCRIPTION OF THE DRAWINGS

FIG. 1 is a side elevation view of a block according to the invention, without its soft attachment.

DETAILED DESCRIPTION OF THE INVENTION

Referring now to FIGS. 1-6, the invention will be described in detail.

Figure 1:
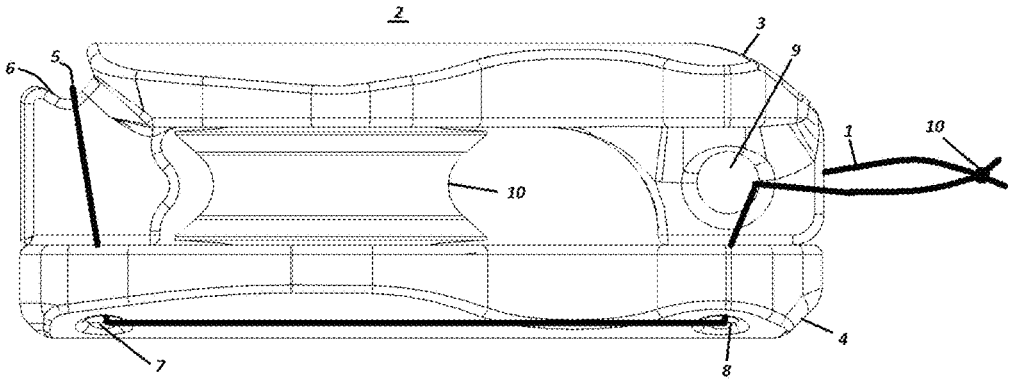
FIG. 1 is a side elevation view of a block according to the invention, including its soft attachment.
Figure 2:
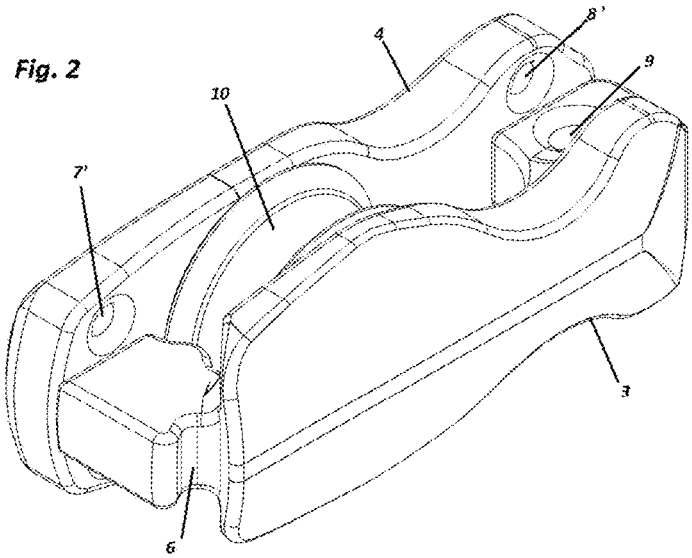
FIG. 2 is an isometric perspective view of a block according to the invention, without its soft attachment.
Figure 3:
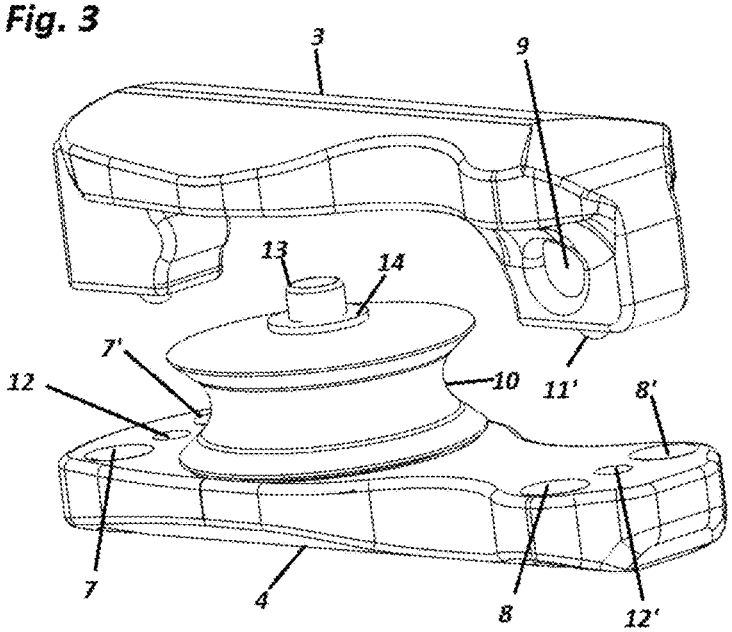
FIG. 3 is a partially exploded view of a block according to the invention, without its soft attachment.
Figure 4:
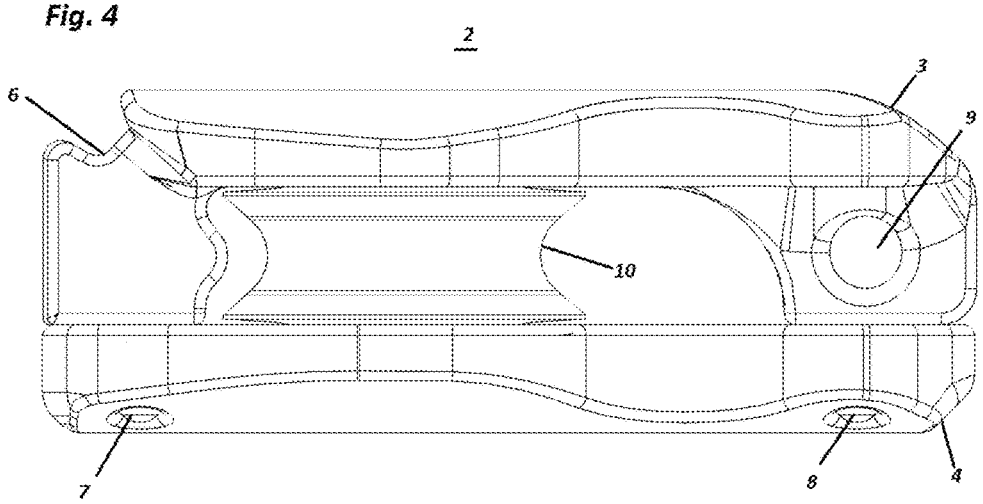
FIG. 4 is
Figure 5:
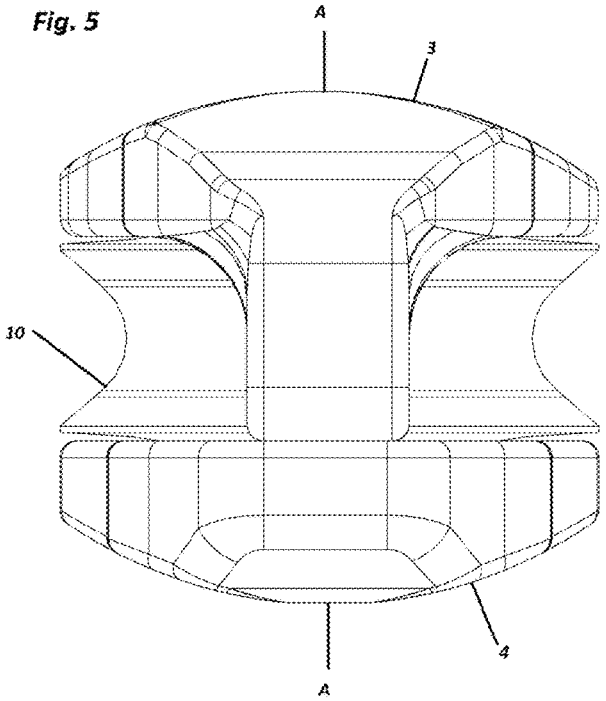
FIG. 5 is an end elevation view of a block according to the invention, without its soft attachment.

Referring to FIG. 1, the same rope 1 desirably performs three basic functions:

1. attach block 2 to a boat
2. hinge cheeks 3 and 4 together at one end of block 2, and
3. lock cheeks 3 and 4 together at the other end of block 2.

Rope 1 may be arranged in a "U"-shape along cheek 4. Specifically, loop 5 formed in rope 1 may be placed upon shoulder 6 provided in cheek 4. Then rope 1 may be threaded through apertures 7, 7' and 8, 8' provided in cheek 4. Then rope 1 may be led up and through aperture 9 within cheek 3, passing through it from either side of cheek 3 and crossing upon itself within aperture 9.

Rope 1 may be led out of aperture 9 and formed into a loop which may desirably be tied by knot 10. Knot 10 may be a figure-8 knot. Knot 10 may optionally be replaced by sewing, heat-sealing, adhesive, splicing, riveting, crimping, welding and/or other suitable means of temporary or permanent closure.

Rope 1 crosses upon itself through aperture 9 provided in cheek 3, forming an X-configuration. Sliding friction in the X-configuration region and within apertures 7, 7' and 8, 8' holds block 2 closed even when it is not under load. It opens when a user manually removes loop 5 from shoulder 6 provided at the latching end of block 2, by pulling loop 5 away from shoulder 6. In contrast, when block 2 is under load, loop 5 is urged towards shoulder 6 to hold cheeks 3 and 4 of block 2 together.

The center of aperture 9 is positioned even with sheave 10. This insures that when load is applied, line 1 crossing over itself in an X-configuration will self-adjust so as to keep cheeks 3 and 4 together; as well as to keep a loaded line centered on sheave 10 so it does not tend to cock to either side.

Cheek 3 is positioned on cheek 4 by means of pins 11, 11' that engage corresponding sockets 12, 12'. This prevents cheek 3 from sliding on cheek 4 when under load, so that both cheeks may share the load. Once pins 11, 11' engage sockets 12, 12' and block 2 is under tension from rope 1, friction between cheeks 3 and 4 (which are then automatically urged toward each other) also serves to promote their load-bearing cooperation.

Sheave 10 rotates about spindle 13 which may desirably be a lightweight tube of aluminum, titanium or other material of suitable strength. Spindle 13 may be press-fit into cheek 4; or optionally be secured to it by adhesive or integrally molded therewith. Retaining ring 14 secures sheave 10 onto spindle 13 by press-fit, when cheek 3 is in its open position (separated from cheek 4).

Since the material from which sheave 10 may be manufactured may be ABS/PC (polycarbonate), it may have a low coefficient of friction enabling it to rotate easily about a spindle 13 made of aluminum. Expensive ball- or roller-bearings are not needed; although they may optionally be employed.

Figure 6:
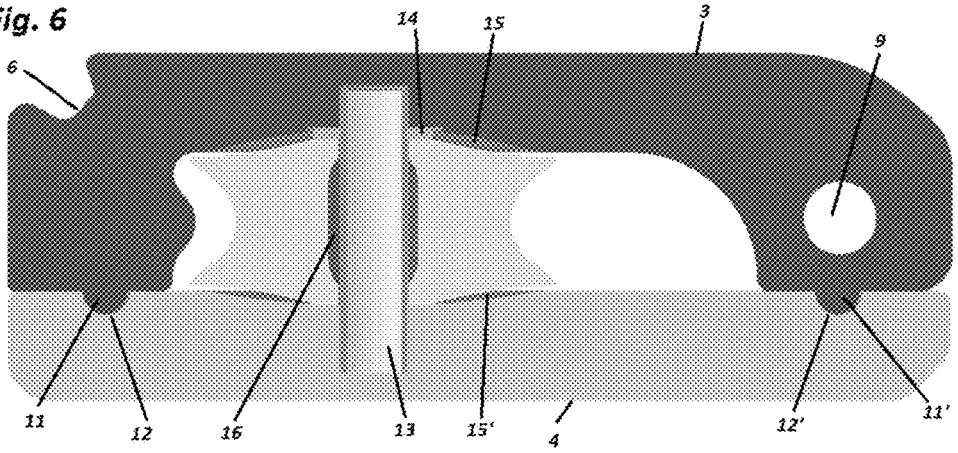
FIG. 6 is a sectional view of a block according to the invention, taken along line A-A of FIG. 5.

Referring now to FIG. 6, the sides of sheave 10 may be tapered from its central axis to its circumference. This feature affords a wide base for mounting sheave 10 upon spindle 13, affording stability so it is less likely to get cocked on spindle 13 if an unwanted side force were accidentally applied by the load. Cheeks 3 and 4 may be provided with suitable recesses 15, 15' for clearing the wide center region of sheave 10.

Further referring to FIG. 6, sheave 10 may be provided with an internal recess 16 so that sheave 10 touches spindle 13 substantially only at widely-spaced points of contact, thereby minimizing friction and promoting free rotation of sheave 10 about spindle 13.

In the event cheeks 3 and 4 and sheave 10 are 3D-printed from ABS/PC in sparse mode, and spindle 13 is an aluminum tube, block 2 may be enjoy a specific gravity <1 so that it floats upon water.

Since rope 1 provides a soft attachment for block 2; and since desirable friction along rope 1 (where it contacts cheeks 3 and 4; and crosses upon itself at aperture 9) holds cheeks 3 and 4 substantially in position even in absence of an applied load, block 2 is substantially capable of handling not only those loads that may be in line with its major axis, but also those that may initially be applied from an off-axis direction.

The invention is not limited to the exact embodiments and uses shown and described, and may be realized and implemented in such other ways as will be apparent to the skilled artisan, utilizing the teachings of the invention.

The invention claimed is:

1. A line-handling device comprising a spindle, a sheave rotatably mounted on said spindle, first and second cheeks, and a soft attachment; said spindle being mounted on said first cheek; said second cheek having first and second ends; said first end of said second cheek being hinged to said first cheek by said soft attachment; said second end of said second cheek being provided with a shoulder for detachably receiving a loop of said soft attachment.

2. A line-handling device according to claim 1, further comprising a sheave-retainer; said spindle having first and second ends; said first end of said spindle being mounted on said first cheek; and said sheave-retainer being mounted on said second end of said spindle regardless of the orientation of said second cheek with respect to said spindle.

3. A line-handling device according to claim 1, said first and second cheeks being provided with a set of cooperating engagements for maintaining the relative positions of said cheeks against shear when said cheeks are in proximity to each other.

4. A line-handling device according to claim 1, said sheave being tapered from a central axis of the sheave to a circumference of the sheave; said sheave being wider at said central axis than at said circumference; and said first and second cheeks being provided with recesses for closely accommodating said taper of said sheave.

5. A line-handling device according to claim 4, said sheave being provided with an internal recess; and said sheave touching said spindle substantially only at widely-spaced points of contact.

6. A line-handling device according to claim 1, said second cheek being provided with an aperture for receiving said soft attachment; and said soft attachment crossing upon itself within said aperture.

7. A line-handling device according to claim 1, said first cheek being provided with a set of apertures; and portions of said soft attachment being located within each aperture of said set of apertures.

* * * * *